US010604309B2

(12) United States Patent
Levy et al.

(10) Patent No.: US 10,604,309 B2
(45) Date of Patent: Mar. 31, 2020

(54) TRAVEL BOTTLE WITH SLIDE LOCK

(71) Applicant: Navajo Manufacturing Company, Inc., Denver, CO (US)

(72) Inventors: Gordon Levy, Golden, CO (US); Shawn A. Shelton, Highlands Ranch, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 0 days.

(21) Appl. No.: 16/123,631

(22) Filed: Sep. 6, 2018

(65) Prior Publication Data

US 2019/0382168 A1 Dec. 19, 2019

Related U.S. Application Data

(60) Provisional application No. 62/686,724, filed on Jun. 19, 2018.

(51) Int. Cl.
*B65D 47/08* (2006.01)
*B65D 47/12* (2006.01)

(52) U.S. Cl.
CPC ..... *B65D 47/0885* (2013.01); *B65D 47/122* (2013.01); *B65D 2251/1066* (2013.01); *B65D 2547/06* (2013.01)

(58) Field of Classification Search
CPC ..... B65D 47/0885; B65D 47/122; B65D 2251/1066; B65D 2547/06
USPC ..... 220/254.2, 254.9, 253, 715; 222/556
See application file for complete search history.

(56) References Cited

U.S. PATENT DOCUMENTS

| | | | | |
|---|---|---|---|---|
| 2,582,360 | A | 1/1952 | Sheridan | |
| 3,094,255 | A | 6/1963 | Hunter | |
| 3,358,890 | A | 12/1967 | Dalfo | |
| 3,460,719 | A | 8/1969 | O'Donnell et al. | |
| 3,484,023 | A | 12/1969 | Meshberg | |
| 3,655,099 | A | 4/1972 | Hazard | |
| 3,702,165 | A | 11/1972 | Carrow et al. | |
| 3,784,060 | A | 1/1974 | Hazard | |
| 3,847,313 | A | 11/1974 | Micallef | |
| 3,848,778 | A | 11/1974 | Meshberg | |
| 3,873,005 | A | 3/1975 | Hazard | |
| 3,874,568 | A | 4/1975 | La Vange et al. | |
| 4,047,643 | A | 9/1977 | Hazard | |
| 4,081,113 | A | 3/1978 | Hazard | |
| 4,299,339 | A | 11/1981 | Giroux et al. | |
| 4,303,178 | A * | 12/1981 | Ford, Jr. | B65D 47/28 220/253 |
| 4,487,342 | A | 12/1984 | Shy | |
| 4,500,016 | A | 2/1985 | Funfstuck | |
| 4,542,837 | A | 9/1985 | Rayner | |
| 4,591,079 | A | 5/1986 | Bigotte | |
| 4,645,086 | A | 2/1987 | Rosenthal | |
| 4,776,501 | A | 10/1988 | Ostrowsky | |
| 4,779,773 | A | 10/1988 | Bennett | |
| 4,852,770 | A | 8/1989 | Sledge et al. | |
| 4,962,869 | A | 10/1990 | Gross et al. | |

(Continued)

*Primary Examiner* — James N Smalley
(74) *Attorney, Agent, or Firm* — Studebaker & Brackett PC

(57) ABSTRACT

A bottle includes a secure sealing mechanism. A slide switch plate maintains the contents of the bottle. This is achieved by automatically securing a dispensing mechanism in a closed, locked position by closing of a lid of the bottle and sealing an outlet so that any liquids are prevented from exiting the bottle.

10 Claims, 5 Drawing Sheets

(56) References Cited

U.S. PATENT DOCUMENTS

| | | | | |
|---|---|---|---|---|
| 5,141,129 | A | 8/1992 | Jennings | |
| 5,284,264 | A | 2/1994 | Gross | |
| 5,314,093 | A | 5/1994 | Gross et al. | |
| 5,573,127 | A * | 11/1996 | Takahashi | B65D 47/0814 215/237 |
| 5,622,284 | A | 4/1997 | Sawicki | |
| 5,649,645 | A | 7/1997 | Demarest et al. | |
| 6,283,333 | B1 | 9/2001 | Knickerbocker et al. | |
| 6,557,717 | B1 * | 5/2003 | Keck | A47G 19/2272 220/254.9 |
| 6,626,314 | B1 * | 9/2003 | McHenry | B65D 47/265 220/254.2 |
| 6,896,160 | B2 | 5/2005 | Kaufman et al. | |
| 6,971,547 | B2 | 12/2005 | Englert et al. | |
| 9,382,059 | B2 | 7/2016 | Selinger et al. | |
| 2003/0038146 | A1 | 2/2003 | Meshberg | |
| 2004/0112927 | A1 | 6/2004 | Kaufman et al. | |
| 2009/0057324 | A1 * | 3/2009 | Wang Wu | B65D 47/249 220/711 |
| 2010/0102060 | A1 * | 4/2010 | Ruse, Jr. | B65D 43/0204 220/254.9 |
| 2013/0206764 | A1 * | 8/2013 | Arnold | B65D 25/2885 220/253 |
| 2013/0220966 | A1 * | 8/2013 | Lane | A45F 3/16 215/228 |
| 2014/0175042 | A1 * | 6/2014 | Lane | B65D 43/26 215/229 |

* cited by examiner

TRAVEL BOTTLE WITH SLIDE LOCK

This application claims the benefit of priority to U.S. Provisional Patent Application No. 62/686,724, filed on Jun. 19, 2018, which is hereby incorporated by reference in its entirety.

FIELD OF THE INVENTION

The present invention relates to the field of bottles which require a secure locking to prevent accidental dispensing of its contents.

BACKGROUND OF THE INVENTION

Oftentimes, when traveling, individuals carry miniaturized versions of full sized liquid content bottles. However, the problem encountered is that the small, travel size bottles often leak or accidentally dispense fluids due to contact with the exterior of the bottle or pressurization of an airline compartment which forces liquids from the bottle. This causes a mess throughout all of the travel contents.

SUMMARY OF THE INVENTION

By the present invention, a travel bottle includes a secure sealing mechanism. A slide switch plate maintains closure of and access to the contents of the bottle. This is achieved by securing a dispensing mechanism in a closed, locked position and sealing an outlet so that any liquids are prevented from exiting the bottle.

This is achieved by the use of a bottle cap having a lid that can be opened and closed. When the lid is moved into the closed position the bottle is automatically "locked" by a slide switch plate moved to a locked position. Conversely, when the lid is moved into the opened position the slide switch plate is automatically moved to an open position to gain access to the interior contents of the bottle.

When the slide switch is moved to a locked position by the closing of the lid, the slide switch plate covers the outlet channel of the bottle. This keeps the contents of the bottle from being dispensed under pressure.

Accordingly, it is an object of the present invention to provide a travel bottle with a slide switch plate lock.

It is another object of the present invention to provide a travel bottle with a slide switch plate lock to move between a locked position and an unlocked position.

It is still yet another object of the present invention to provide a travel bottle with a slide switch plate lock to move between a locked position and an unlocked position and automatically moving the slide switch plate into the locked position upon closure of the lid.

It is still another object of the present invention to provide a travel bottle with a slide switch plate lock to move between a locked position and an unlocked position and automatically moving the slide switch plate into the locked position upon closure of the lid and automatically moving the slide switch plate into the unlocked position upon opening of the lid.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
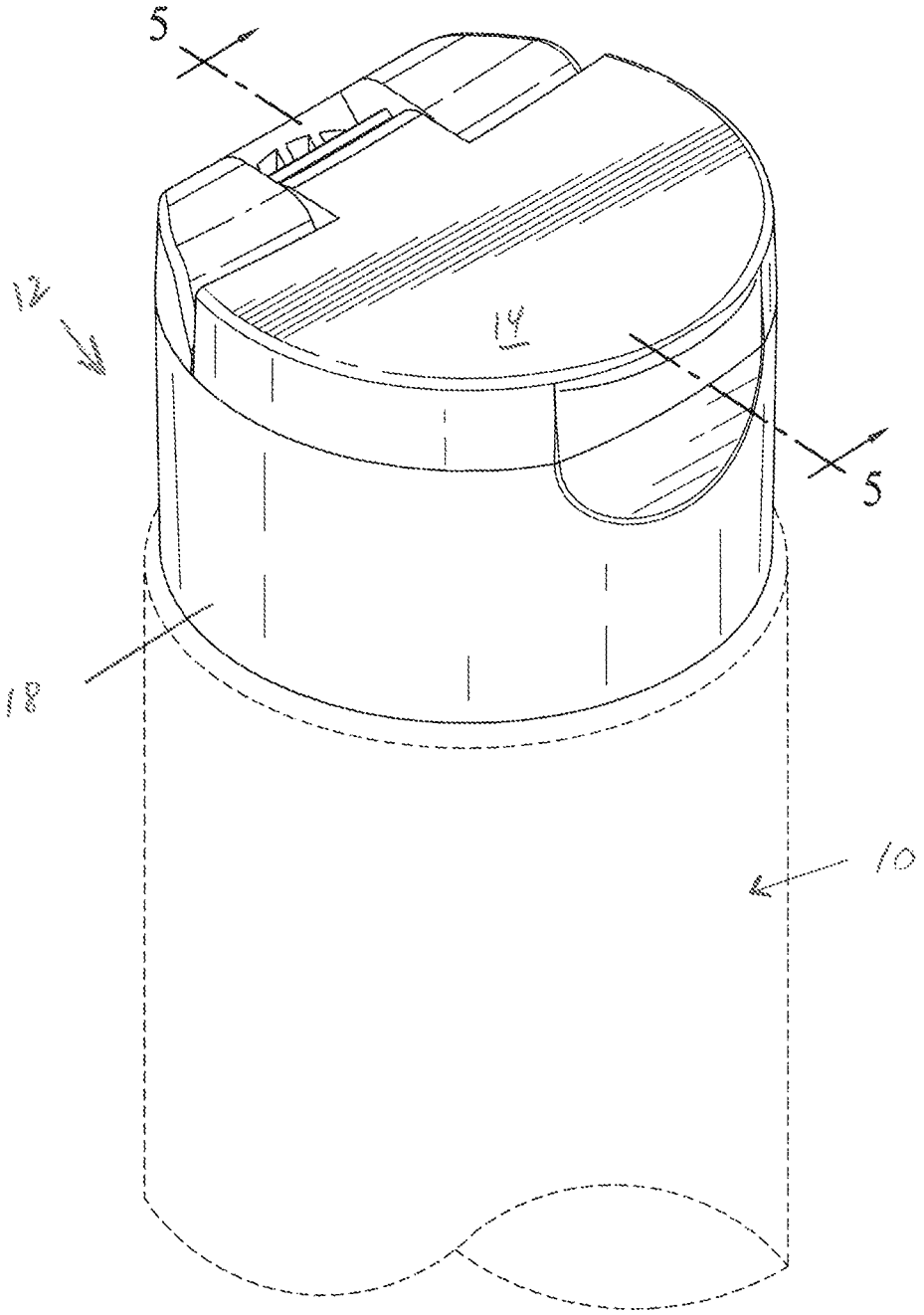
FIG. 1 illustrates a travel bottle having a locking mechanism secured to a top of the bottle.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
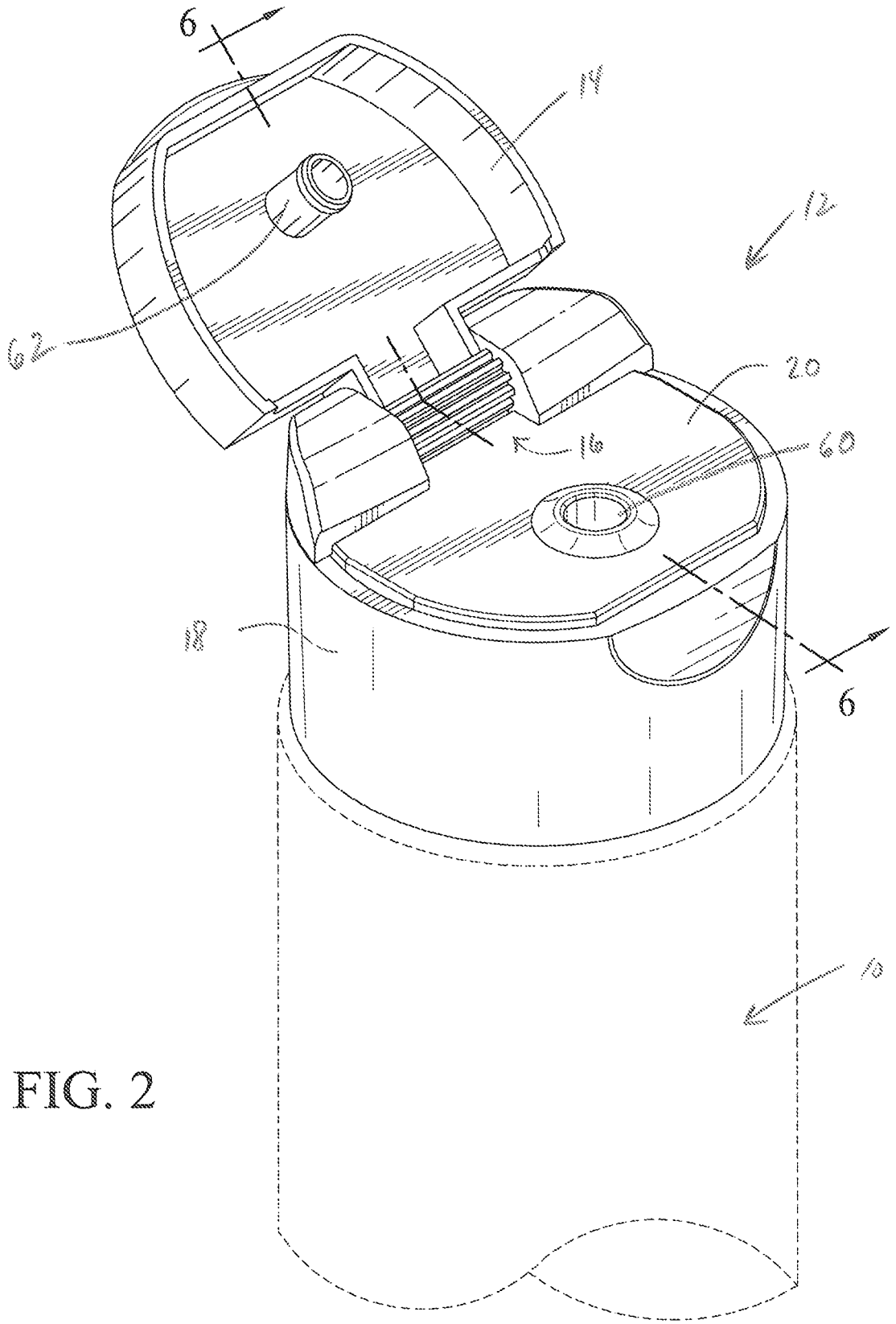
FIG. 2 illustrates an open position of a lid of the locking mechanism.
Figure 3:
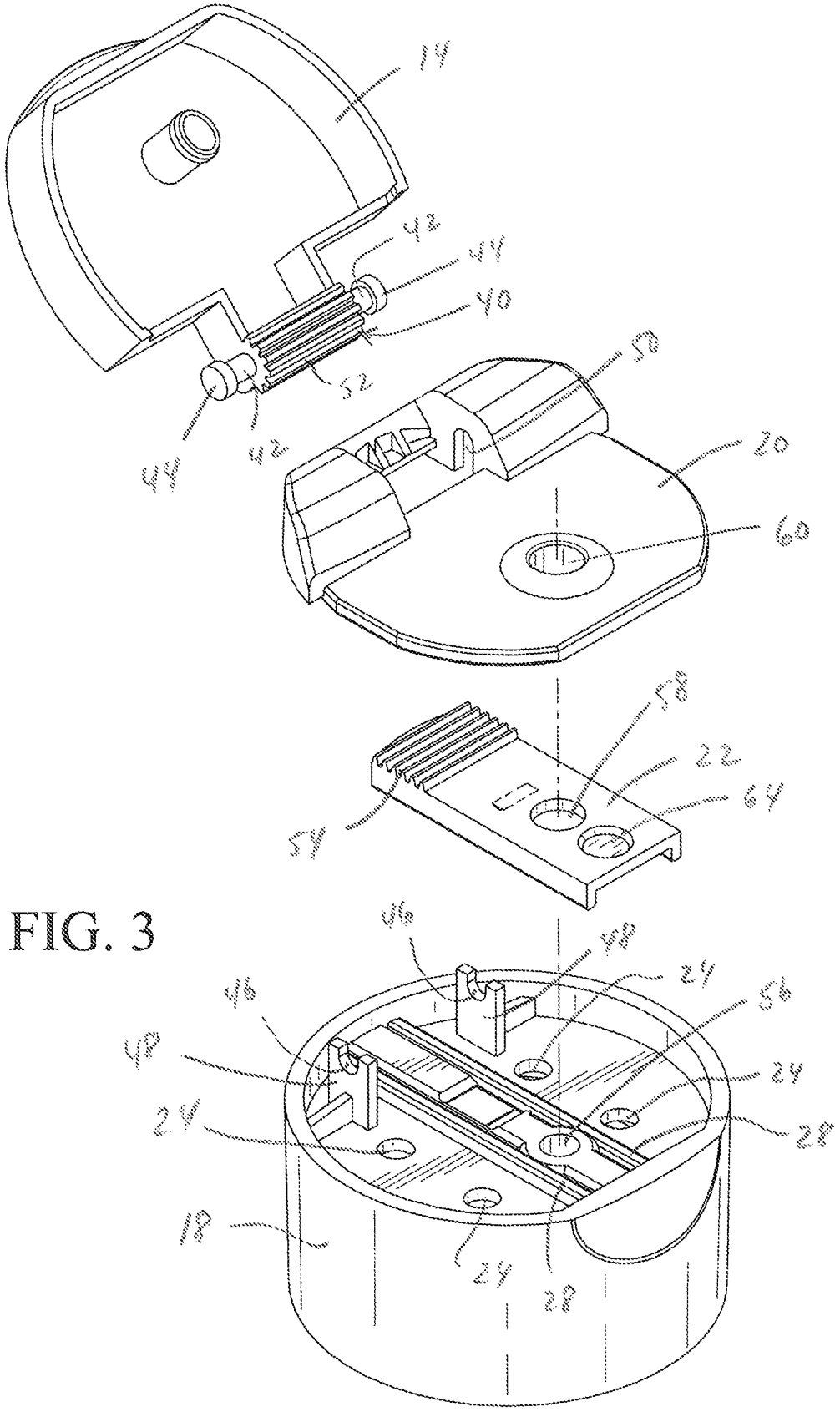
FIG. 3 is an exploded view of the locking mechanism.
Figure 4:
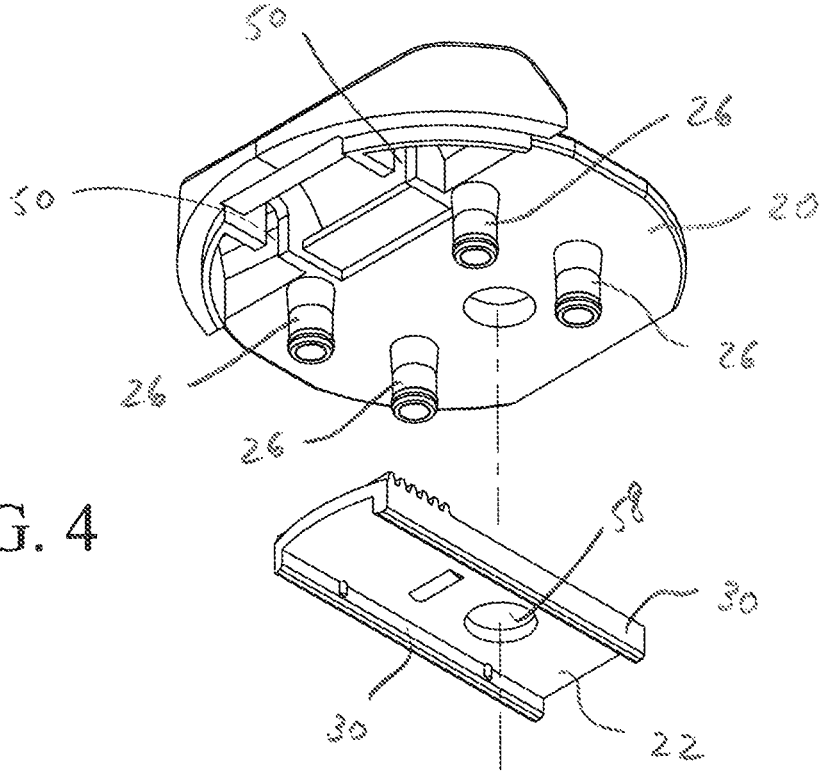
FIG. 4 is an exploded view, illustrating a slide switch plate spaced from a top plate of the locking mechanism.

As shown in FIGS. 1 through 4, a travel bottle 10 includes a locking mechanism 12 threadably mounted on the bottle 10. A lid 14 is pivotally mounted by a rack and pinion assembly 16 onto main body 18. Secured to the main body 18 is a top plate 20. Inter-deposed between the main body 18 and the top plate 20 is a slide switch plate 22 as best shown in FIGS. 3 and 4.

In FIG. 3, the main body 18 includes a plurality of openings 24 spaced about its periphery for receipt of extrusions 26 of the top plate 20. The extrusions 26 fit within the openings 24 to secure the two pieces together with the slide switch plate 22 therebetween.

The main body 18 also includes guide tracks 28 for cooperating with projections 30 located on the underside of the U-shaped slide switch plate 22. Projections 30 provide glide and guide assistance along the outside of the guide tracks 28 while the slide switch plate is being moved.

Integrally formed with lid 14 is pinion portion 40 of rack and pinion assembly 16. This is best shown in FIG. 3. On opposite ends of the pinion portion 40 are shafts 42 terminating at their free ends with pins 44. The shafts 42 are seated within cradles 46 of upstanding projections 48 which extend upwardly from the main body 18. The portions of the shafts 42 located closest to the pinion portion 40 are captured within U-shaped grooves 50 of the top plate 20.

With the slide switch plate 22 mounted on the tracks 28 of the main body 18, the teeth of pinion portion 40 are located within the grooves 54 located at one end of the slide switch plate 22. This cooperation of parts is best shown in the sectional views of FIGS. 5 and 6.

For dispensing products from the interior of the bottle 10, the main body 18 includes an outlet 56. The slide switch plate 22 includes a passage 58 for allowing or preventing passage of fluids from the interior of the bottle 10. The final point of egress of the contents of the bottle 10 is made possible through outlet opening 60.

Figure 5:
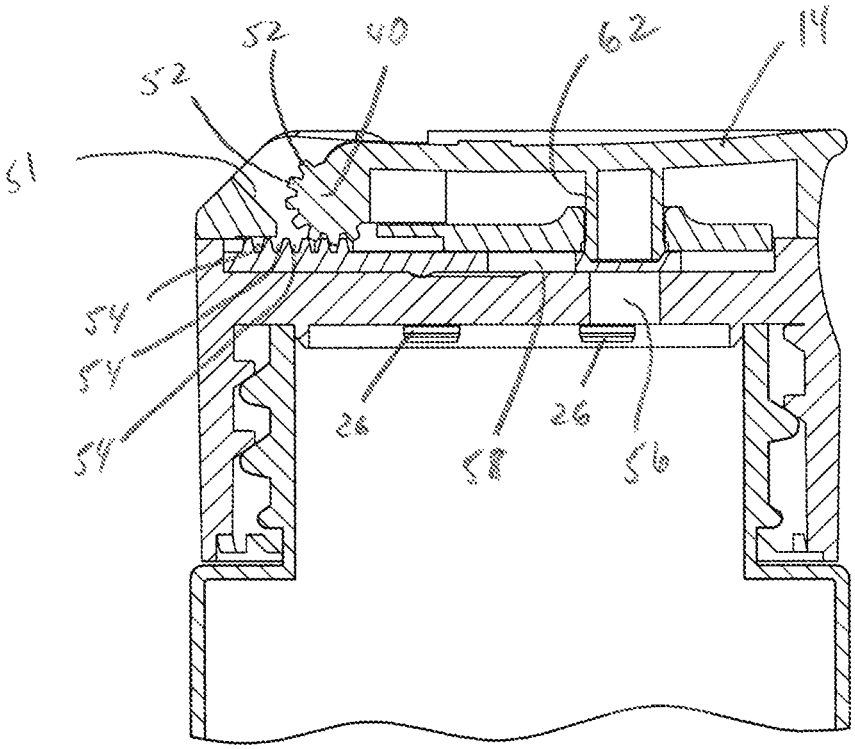
FIG. 5 is a cross sectional view taken along line 5-5 of FIG. 1.

In operation, the lid 14 is initially shown in the closed position of FIGS. 1 and 5. In this position, a plug extrusion 62 located on an underside of the lid is shown extending through opening 60 of top plate 20 and seated within a recess 64 of slide switch plate 22.

Figure 6:
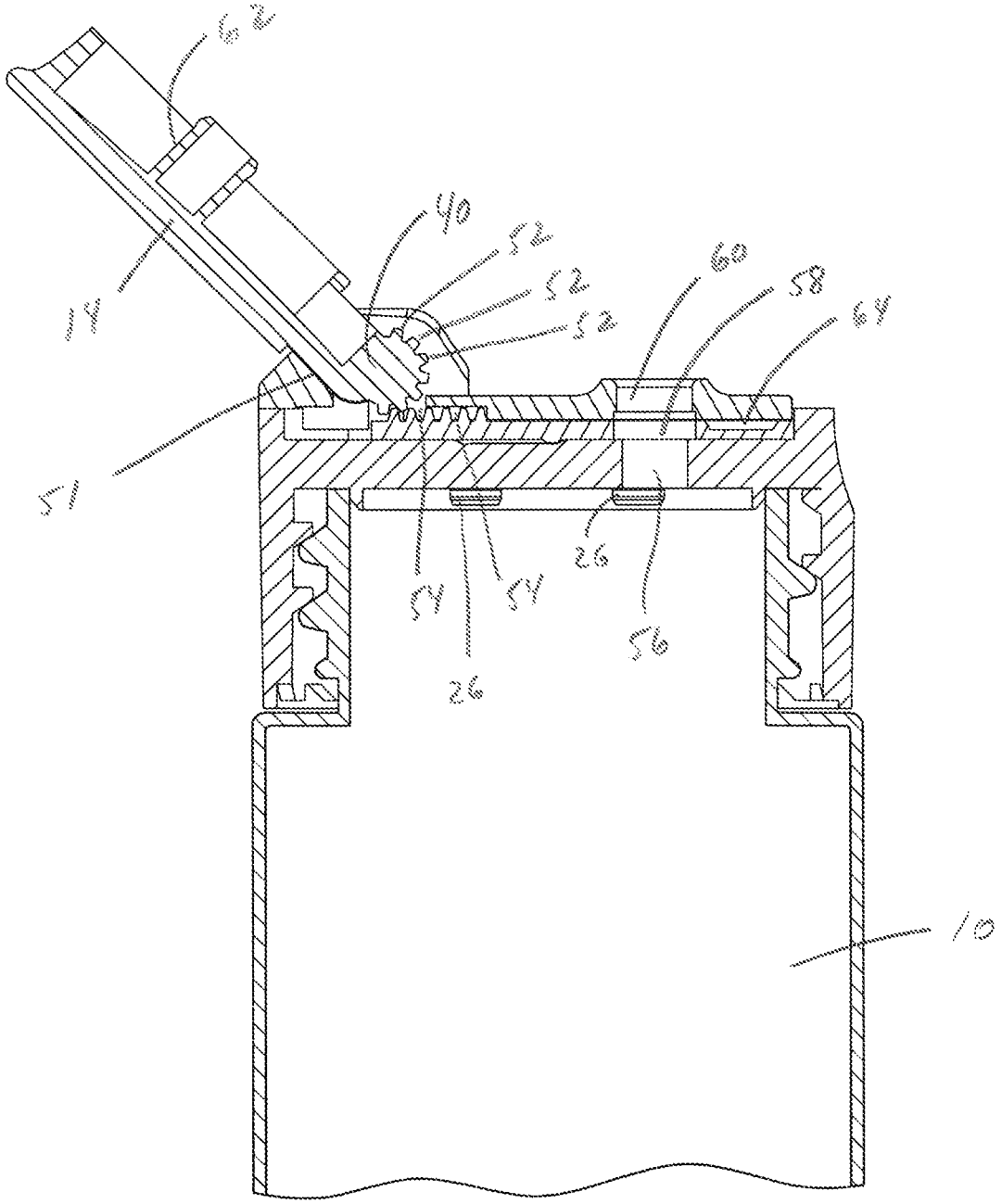
FIG. 6 is a cross sectional view taken along line 6-6 of FIG. 2.

During manual opening of the lid 14 from the closed or locked position shown in FIGS. 1 and 5, the lid is moved to the open or unlocked position shown in FIGS. 2 and 6. During this movement, the teeth 52 of the pinion 40 engaged with the grooves 54 of the slide switch plate 20, force the slide switch plate forward for approximately 0.25 inches. The lid 14 moves rearwardly until engaging and resting against sloped wall 51 of the top plate 20.

Rearward movement of the slide switch plate 20 moves the passage 58 to be located above the outlet 56 and also into alignment with the outlet opening 60. As shown in FIG. 6, the alignment of the outlet 56, passage 58 and outlet opening 60 allows dispensing of fluids from the interior of the bottle 10.

During reverse movements of the lid 14, back towards the position shown in FIGS. 1 and 5, the teeth 52 of the pinion 40 engaged in the grooves 54 of the slide switch plate 22, force the slide switch plate to be moved rearwardly approximately 0.25 inches so that the slide switch plate covers outlet 56 to prevent escape of the contents of the bottle 10. The plug extrusion 62 is simultaneously moved down and through outlet opening 60 into engagement with recess 64 of the slide switch plate 20. This seals the contents of the bottle 10.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A cap of a dispensing bottle, said cap comprising a main body having a lid, said lid being movable into an open position and a closed position, a top body secured to said main body, and a switch plate secured between said main body and said top body, said switch plate slidably moving between a locked position and an unlocked position, said switch plate being automatically moved from said unlocked position into said locked position by said lid being moved from said open position into said closed position and said switch plate being automatically moved from said locked position into said unlocked position by said lid being moved from said closed position into said open position, said main body, said top body and said switch plate each including a passageway, said passageway of said main body, said passageway of said top body and said passageway of said switch plate being aligned for passage therethrough of a liquid when said switch plate is in said unlocked position, said lid including a protrusion plug on an underside of said lid, said lid being mounted on said main body to close said passageway of said top body with said plug protrusion when said lid is moved from said open position into said closed position, said protrusion plug being sized to fit in said passageway of said top body, said switch plate including a recess for receipt of said protrusion plug when said lid is closed and said switch plate is in said locked position with said protrusion plug extending through said passageway of said top body.

2. The cap of a dispensing bottle according to claim 1, wherein said lid and said switch plate include a rack and pinion assembly.

3. The cap of a dispensing bottle according to claim 2, wherein said lid engages said switch plate by said rack and pinion assembly and allows said lid to move from said open position to said closed position while said switch plate is moved from said unlocked position into said locked position.

4. The cap of a dispensing bottle according to claim 1, wherein said passageway of said main body and said passageway of said top body are blocked by said switch plate when said switch plate is in said locked position.

5. The cap of a dispensing bottle according to claim 3, wherein said rack and pinion assembly includes a pinion portion of said lid engaged with said top body and a rack portion formed in said switch plate.

6. The cap of a dispensing bottle according to claim 1, wherein said switch plate is movable over a distance of approximately 0.25 inches from the locked position to the unlocked position after moving of said lid from said closed position to said open position.

7. A cap of a dispensing bottle, said cap comprising a main body having a lid, said lid being movable into an open position and a closed position, a top body secured to said main body, and a switch plate secured between said main body and said top body, said switch plate slidably moving between a locked position and an unlocked position, said switch plate being automatically moved from said unlocked position into said locked position by said lid being moved from said open position into said closed position and said switch plate being automatically moved from said locked position into said unlocked position by said lid being moved from said closed position into said open position, said lid and said switch plate including a rack and pinion assembly.

8. The cap of a dispensing bottle according to claim 7, wherein said lid engages said switch plate by said rack and pinion assembly and allows said lid to move from said open position to said closed position while said switch plate is moved from said unlocked position into said locked position.

9. The cap of a dispensing bottle according to claim 8, wherein said rack and pinion assembly includes a pinion portion of said lid engaged with said top body and a rack portion formed in said switch plate.

10. A cap of a dispensing bottle, said cap comprising a main body having a lid, said lid being movable into an open position and a closed position, a top body secured to said main body, and a switch plate secured between said main body and said top body, said switch plate slidably moving between a locked position and an unlocked position, said switch plate being automatically moved from said unlocked position into said locked position by said lid being moved from said open position into said closed position and said switch plate being automatically moved from said locked position into said unlocked position by said lid being moved from said closed position into said open position, said main body, said top body and said switch plate each including a passageway, said passageway of said main body, said passageway of said top body and said passageway of said switch plate being aligned for passage therethrough of a liquid when said switch plate is in said unlocked position, said passageway of said main body and said passageway of said top body being blocked by said switch plate when said switch plate is in said locked position.

* * * * *